United States Patent [19]

Ampferer

[11] Patent Number: 4,898,125

[45] Date of Patent: Feb. 6, 1990

[54] CYLINDER HEAD COVER WITH SUCTION PIPE ARRANGEMENT FOR AN INTERNAL COMBUSTION ENGINE

[75] Inventor: Herbert Ampferer, Sachsenheim, Fed. Rep. of Germany

[73] Assignee: Dr. Ing. h.c.F. Porsche AG, Weissach, Fed. Rep. of Germany

[21] Appl. No.: 243,603

[22] Filed: Sep. 13, 1988

[30] Foreign Application Priority Data

Sep. 14, 1987 [DE] Fed. Rep. of Germany ..... 3730817

[51] Int. Cl.[4] ..... F22B 9/08

[52] U.S. Cl. ..... 123/52 MC; 123/195 C

[58] Field of Search ..... 123/52 M, 52 MV, 52 MC, 123/198 E, 195 C

[56] References Cited

U.S. PATENT DOCUMENTS 4,470,378 9/1984 Malik et al. ..... 123/52 MC

FOREIGN PATENT DOCUMENTS 2263048 6/1973 Fed. Rep. of Germany .

2339356 6/1977 Fed. Rep. of Germany .

2628692 5/1984 Fed. Rep. of Germany .

*Primary Examiner*—Noah P. Kamen

[57] ABSTRACT

A cylinder head cover with a suction pipe arrangement for an internal combustion engine in which the cylinder head cover and the suction pipe arrangement form a structural unit which is retained at a cylinder head of the internal combustion engine by means of bolts and elastic elements so that the noise radiation of the internal combustion engine is reduced. Additionally, in order to avoid filling losses, a wall of the cylinder head cover which is a component of the suction pipe arrangement, is compartmentalized against hot spray oil out of the cylinder head by means of a covering.

15 Claims, 1 Drawing Sheet

CYLINDER HEAD COVER WITH SUCTION PIPE ARRANGEMENT FOR AN INTERNAL COMBUSTION ENGINE

BACKGROUND AND SUMMARY OF THE INVENTION

The present invention relates to a cylinder head cover suction pipe arrangement for an internal combustion engine of the four-cycle-reciprocating-piston-type which formed as a structural unit retained at a cylinder head of the internal combustion engine by means of a seal and bolts.

An internal combustion engine is known—DE-AS 23 39 356—in which the suction pipe arrangement and the cylinder head cover are structurally combined. This unit is rigidly secured at the cylinder head by means of bolts. This construction entails the disadvantage that the internal combustion engine radiates disturbing noises by way of the unit's rigid type of fastening. Also, the wall of the cylinder head cover, facing the cylinder head, is continually acted upon with hot oil out of the cylinder head during the operation of the internal combustion enginer. This leads to an undesirable heating of the suction pipe arrangement and consequently to a reduced filling of the cylinders connected downstream thereof.

It is the object of the present invention to so fasten the structural unit of the cylinder head cover suction pipe arrangement at the cylinder head that noise radiations are reduced. This fastening ensures that a heat-up of the suction pipe by spray oil out of the cylinder head is avoided.

The underlying problems are solved according to the present invention in that elastic elements are arranged between the heads of the bolts or screws extending perpendicularly to a separating plane of the cylinder head cover and of the cylinder head, on the one hand, and support parts of the structural unit aligned parallel to this separating plane, on the other.

The advantages principally achieved with the present invention reside in that the structural unit, consisting of cylinder head cover and suction pipe arrangement, is retained at the cylinder head decoupled by the elastic elements. As a result of this decoupling, a noticeable noise reduction of the internal combustion engine is attained. Bolts or screws are screwed into fastening bolts of the multi-partite cylinder head which, on the one hand, assures a safe retention of the structural unit and, on the other, minimizes the mechanical expenditure for threaded bores in the cylinder head. The fastening bolts are parts that can be easily manufactured in automatic machinery.

The covering between the cylinder head and the wall of the cylinder head cover, forming a part of the suction pipe arrangement which is adjacent thereto, prevents an undesired heat-up of the suction pipe arrangement so that filling of the cylinders, which are charged by means of the suction pipe arrangement, is of high quality.

Finally, the cover is a simple structural part easily installed by means of the seal between the cylinder head cover and the cylinder head.

BRIEF DESCRIPTION OF THE DRAWINGS

These and other objects, features and advantages of the present invention will become more apparent from the following description when taken in connection with the accompanying drawing which shows, for purposes of illustration only, two embodiments in accordance with the present invention, and wherein.

DETAILED DESCRIPTION OF THE DRAWINGS

Figures 1, 2, 3:
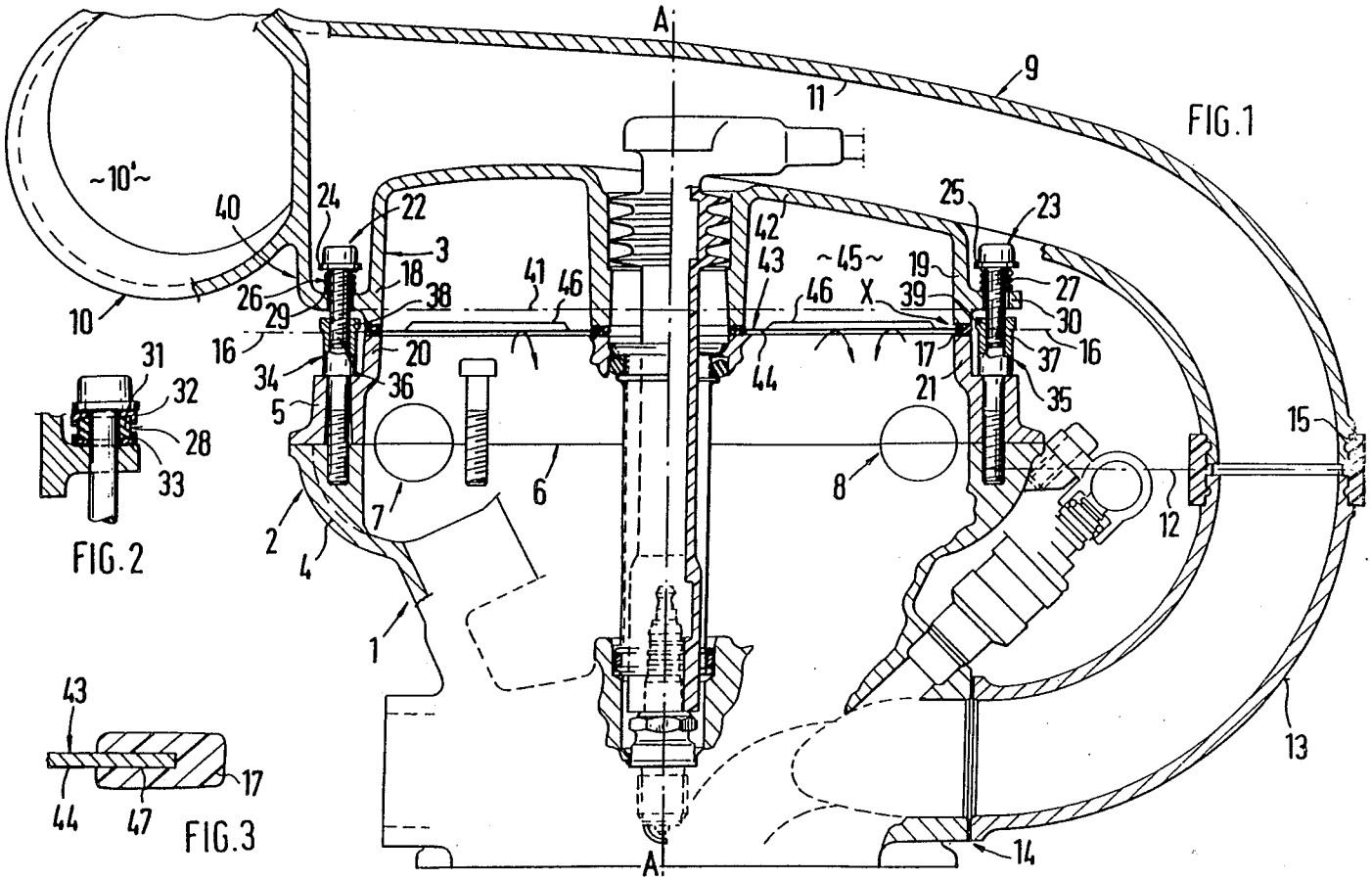
FIG. 1 is a partial cross-sectional view through an internal combustion engine in accordance with the present invention.
FIG. 2 is a partial cross-sectional view of FIG. 1 of a modified embodiment in accordance with the present invention.
FIG. 3 is a cross-sectional view of a detail X of Figure 1, on an enlarged scale.

Referring now to the drawing wherein like reference numerals are used throughout the various views to designate like parts, FIG. 1 shows a multi-cylinder engine, internal combustion engine that operates according to the four-cycle process and includes a cylinder head 2 with a cylinder head cover 3. The cylinder head 2 is multi-partite, i.e., it is formed by a lower part 4 and an upper part 5 (also referred to as cam shaft housing. Both parts 4 and 5 are assembled in a separating plane 6 which extends at right to a longitudinal center plane A—A of the internal combustion engine 1. Cam shafts are indicated at 7 and 8 each actuate two inlet valves and two exhaust valves per cylinder which is not illustrated.

The cylinder head cover 3 is formed together with a suction pipe arrangement 9 into a structural unit 10, i.e., the suction pipe arrangement 9 is made in one piece with the cylinder head cover 3. The suction pipe arrangement 9 includes a manifold space 10' and a pipe section 11 extending arcuately and transversely over the cylinder head 2 to a plane 12 that extends parallel to the separating plane 6. In this plane 12, the pipe section 11 is connected to a right angle arcuate pipe portion 13 that is rigidly connected with the cylinder head at 14. The pipe section 11 and the arcuate pipe portion 13—which form nearly a 180° arc—are connected with each other by means of an elastic member 15 which is constructed in the manner of a sleeve. A sleeve of this type is described in the DE-P 36 41 811.

The cylinder head cover 3 of the structural unit 10 has an approximately U-shaped cross section are connected to the cylinder head 2 upper part 5, in a separating plane 16 that extends parallel to the separating plane 6. A seal 17 is arranged between the cylinder head cover 3 and the upper part 5 of the cylinder head 2. The seal 17 is effective between legs 18 and 19 of the cylinder head cover 3, respectively, webs 20 and 21 of the upper part 5.

Bolts 22 and 23 serve for the retention of the structural unit 10 at the cylinder head 2. The bolts are arranged at a distance to one another and more particularly outside of the legs 17 and 18, whereby these bolts are aligned perpendicularly to the separating plane 16.

The bolts 22 and 23 include heads 24 and 25 which stress elastic elements 26, 27 and 28 (FIG. 2) against support parts 29 and 30. Owing to this measure, the structural unit is retained in position at the cylinder head 2 in a decoupled manner. Elastic elements 26 and 27 are coil springs stressed in compression. The elements 28 (FIG. 2) are rubber springs which include a rubber body 31 and metallic support parts 32 and 33 partially surrounding the rubber body 31.

The bolts 22 and 23 are aligned coaxially to fastening bolts 34 and 35 and are screwed into threaded bores 36 and 37 of the heads 38 and 39 of these fastening bolts 34 and 35. The fastening bolts 34 and 35 retain the multipartite cylinder head 2 which consists of the lower part 4 and of the upper part 5 together.

The support parts 29 are provided at local fastening eyes 40 of circular cross section, which are formed-in into the structural unit 10. By contrast, the support parts 30 extend flange-like and laterally away from the cylinder head cover 3. The support parts 29 and 30 are located in a common plane 41 that extends parallel to the separating plane 6.

Adjacent the separating plane 16, the cylinder head cover 3 includes a wall 42 which extends between the legs 18 and 19 and is component of the pipe section 11 of the suction pipe arrangement 9. In order that this wall 42 is protected against hot spray or splash oil out of the cylinder head, a covering generally designated by reference numeral 43 is provided. The covering 43 is a plane plate 44 which is connected with a seal 17 and extends along the separating plane 16. The space 45 inside the cylinder head cover 3 is thus compartmentalized with respect to the cylinder head 2. The plate 44 which consists of thin-walled sheet metal, is provided with groove-like reinforcements 46 to act as a relatively form-rigid frame. Additionally, the edge 47 of the plate 44 is surrounded fork-like by the seal 17. The plate 44 thus functions in this manner as a reinforcing metal insert for the seal 17.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A cylinder head cover with a suction pipe arrangement for an internal combustion engine of a four-cycle reciprocating-piston type construction which form a structural unit, comprising retaining means including seal means and threaded means for retaining the cylinder head cover at the cylinder head of the internal combustion engine, and threaded means having heads and extending substantially perpendicularly to a separating plane of the cylinder head cover and the cylinder head, elastic means arranged between the heads of the threaded means and support means of the structural unit extending substantially parallel to said separating plane for attaching the heads to the support means, wherein the cylinder head is of multi-partite configuration and the threaded means are screwed into head portions of coaxially arranged fastening bolts which retain the multi-partite cylinder head in position.

2. A cylinder head cover according to claim 1, wherein the multi-partite cylinder head includes an upper part and a lower part.

3. A cylinder head cover with a suction pipe arrangement for an internal combustion engine of a four-cycle reciprocating-piston type construction which form a structural unit, comprising retaining means including seal means and threaded means for retaining the cylinder head cover at the cylinder head of the internal combustion engine, and threaded means having heads and extending substantially perpendicularly to a separating plane of the cylinder head cover and the cylinder head, elastic means arranged between the heads of the threaded means and support means of the structural unit extending substantially parallel to said separating plane for attaching the heads to the support means, wherein the cylinder head cover includes a wall extending adjacent the separating plane, and wherein the wall is compartimentalized against spray oil out of the cylinder head by means of a covering.

4. A cylinder head cover according to claim 3, wherein the covering and the seal means are between the cylinder head and the cylinder head cover and are connected with each other.

5. A cylinder head cover according to claim 4, wherein the covering is a substantially flat plate and includes groove-like reinforcements.

6. A cylinder head cover according to claim 5, wherein the seal means surrounds the plate fork-like—as seen in cross section.

7. A cylinder cover with a suction pipe arrangement for an internal combustion engine of a four-cycle reciprocating-piston type construction which form a structural unit, comprising retaining means including seal means and threaded means for retaining the cylinder head cover at the cylinder head of the internal combustion engine, and threaded means having heads and extending substantially perpendicularly to a separating plane of the cylinder head cover and the cylinder head, elastic means arranged between the heads of the threaded means and support means of the structural unit extending substantially parallel to said separating plane for attaching the heads to the support means, in which an arcuately shaped pipe section of the suction pipe arrangement extending over the cylinder head is connected to an arcuate pipe portion, and wherein the pipe section and the arcuate pipe portion are connected with each other by an elastic means constructed in the manner of a sleeve.

8. A cylinder head cover with a suction pipe arrangement for an internal combustion engine of a four-cycle reciprocating-piston type construction which form a structural unit, comprising retaining means including seal means and threaded means for retaining the cylinder head cover at the cylinder head of the internal combustion engine, and threaded means having heads and extending substantially perpendicularly to a separating plane of the cylinder head cover and the cylinder head, elastic means arranged between the heads of the threaded means and support means of the structural unit extending substantially parallel to said separating plane for attaching the heads to the support means, wherein the elastic means are one of coil springs stressed in compression and rubber springs, wherein the cylinder head is of multi-partite configuration and the threaded means are screwed into head portions of coaxially arranged fastening bolts which retain the multi-partite cylinder head in position.

9. A cylinder head cover according to claim 8, wherein the support means are provided at fastening eyes formed-in into the structural unit and extend flange-like laterally away from the cylinder head cover.

10. A cylinder head cover according to claim 9, wherein the support means are arranged on a common plane extending substantially parallel to the separating plane.

11. A cylinder head cover according to claim 10, wherein the cylinder head cover includes a wall extending adjacent the separating plane, and wherein the wall is compartmentalized against spray oil out of the cylinder head by means of a cover means.

12. A cylinder head cover according to claim 11, wherein the cover means and the seal means between the cylinder head and the cylinder head cover are connected with each other.

13. A cylinder head cover according to claim 12, wherein the cover means is a substantially flat plate and includes groove-like reinforcement.

14. A cylinder head cover according to claim 13, wherein the seal means surrounds the plate fork-like—as seen in cross section.

15. A cylinder head cover according to claim 11, in which an arcuately shaped pipe section of the suction pipe arrangement extending over the cylinder head is connected to an arcuate pipe section, and wherein the pipe portion and the arcuate pipe section are connected with each other by an elastic means constructed in the manner of a sleeve.

* * * * *